US009478342B2

(12) United States Patent
Reuber

(10) Patent No.: US 9,478,342 B2
(45) Date of Patent: Oct. 25, 2016

(54) ACTUATOR FOR MEDIUM VOLTAGE SWITCHGEAR

(71) Applicant: ABB TECHNOLOGY AG, Zürich (CH)

(72) Inventor: Christian Reuber, Willich (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/546,798

(22) Filed: Nov. 18, 2014

(65) Prior Publication Data

US 2015/0137914 A1 May 21, 2015

(30) Foreign Application Priority Data

Nov. 18, 2013 (EP) ..... 13005415

(51) Int. Cl.
*H01F 7/16* (2006.01)
*H01H 33/38* (2006.01)
*H01H 50/04* (2006.01)
(Continued)

(52) U.S. Cl.
CPC ..... *H01F 7/1646* (2013.01); *H01F 7/127* (2013.01); *H01H 3/54* (2013.01); *H01H 33/38* (2013.01); *H01H 50/041* (2013.01); *H01H 51/2209* (2013.01); *H01H 71/10* (2013.01); *H01H 3/28* (2013.01); *H01H 33/6662* (2013.01)

(58) Field of Classification Search
CPC .... H01F 7/1646; H01H 33/38; H01H 71/10; H01H 50/041; H01H 51/2209; H01H 3/54; H01H 3/28; H01H 33/6662
See application file for complete search history.

(56) References Cited

U.S. PATENT DOCUMENTS 3,009,083 A * 11/1961 Sipek ..... H01F 7/202 29/738
6,763,789 B1 * 7/2004 Liang ..... F01L 9/04 123/90.11

(Continued)

FOREIGN PATENT DOCUMENTS

CH EP 2434519 A1 * 3/2012 ..... H01H 50/36
CN 203055590 U * 7/2013

(Continued)

OTHER PUBLICATIONS

Google translation for CN 203055590.*

(Continued)

*Primary Examiner* — Mohamad Musleh
(74) *Attorney, Agent, or Firm* — Taft Stettinius & Hollier LLP

(57) ABSTRACT

An actuator for a switchgear is disclosed, which can include a core having a package of core element layers made of magnetic material, and permanent magnets between the core elements, fixed with screws with screwheads. A movable plate is configured to open or close a magnetic circuit to the core, and an electromagnetic coil is surrounded by the core elements. To avoid mechanical infringement of the environment of the actuator by prominent screwheads, without weakening the magnetic force, screws for mechanical connection of the core element layers and the permanent magnets can be oriented perpendicular to the plane of stacking of the core element layers, and screw-holes for the screws can be implemented through the core element layers and the permanent magnets, and the screw-holes can end in diameter extended openings, so that the screwheads and/or the screw-nuts are recessed into the diameter extended openings.

18 Claims, 5 Drawing Sheets

(51) Int. Cl.

| | |
|---|---|
| ***H01H 51/22*** | (2006.01) |
| ***H01H 3/54*** | (2006.01) |
| ***H01H 71/10*** | (2006.01) |
| ***H01F 7/127*** | (2006.01) |
| *H01H 3/28* | (2006.01) |
| *H01H 33/666* | (2006.01) |

(56) References Cited

U.S. PATENT DOCUMENTS

| | | | | |
|---|---|---|---|---|
| 7,044,438 | B2 * | 5/2006 | Feyerl | F01L 9/04 123/90.11 |
| 7,124,720 | B2 * | 10/2006 | Liang | F01L 9/04 123/90.11 |
| 7,946,261 | B2 * | 5/2011 | Sfaxi | F01L 9/04 123/90.11 |
| 2007/0242408 | A1 * | 10/2007 | Bergstrom | F01L 9/04 361/192 |
| 2009/0039989 | A1 | 2/2009 | Reuber | |
| 2012/0274428 | A1 | 11/2012 | Reuber et al. | |

FOREIGN PATENT DOCUMENTS

| | | | | |
|---|---|---|---|---|
| DE | 71 05 342 | U | 5/1971 | |
| DE | EP 1132929 | A1 * | 9/2001 | H01F 7/1615 |
| DE | 10146899 | A1 * | 4/2003 | H01F 7/1623 |
| EP | 1 843 375 | B1 | 7/2011 | |
| EP | 2 426 690 | A1 | 3/2012 | |
| EP | 2 312 606 | B1 | 2/2013 | |
| GB | 726101 | A * | 3/1955 | H02K 33/06 |
| WO | 2005/024860 | A1 | 3/2005 | |

OTHER PUBLICATIONS

European Search Report for EP 13005415.8 dated Apr. 10, 2014.

* cited by examiner

ACTUATOR FOR MEDIUM VOLTAGE SWITCHGEAR

RELATED APPLICATION(S)

This application claims priority to European Patent Application No. 13005415.8 filed on Nov. 18, 2013, the entire content of which is incorporated herein by reference.

FIELD

The disclosure relates to an actuator for medium voltage switchgear, the actuator including a core which can include a package of core element layers made of magnetic material, permanent magnets between the core elements, which can be fixed with screws with screwheads, a movable plate made of magnetic material, which moves in order to open or close a magnetic circuit to the core, an electromagnetic coil, surrounded by the core elements, and a central actuator rod.

BACKGROUND INFORMATION

A known magnetic actuator is disclosed in EP 1843375 B1. The magnetic actuator can include a core element, permanent magnets and flanks, a movable plate, an axis and a coil.

In order to form a solid actuator unit, the parts of the actuator can be mechanically connected. For example, the core element and the flanks can be fixed so that their upper ends can be aligned with the movable plate to help achieve an optimal locking force of the actuator.

To achieve a mechanically solid connection, a bar, for example, made from non-magnetic material, can be used, which can be fixed with screws to the core element and the flanks of the actuator.

The permanent magnets can rest in place due to outer mechanical constraints. In addition, the permanent magnets can be glued to a neighbouring part.

The dimensional tolerances of screws and their corresponding holes can allow for an adjustment of the core and flanks so that their respective surfaces towards the movable plate can be aligned such that the remaining parasitic air gap in a closed position can be minimised and the locking force can be maximised.

The bar and the heads of the screws need space in the close environment of the actuator. This space may be unavailable, or the space needed can reduce the maximum size and locking force of the actuator.

A known arrangement is disclosed in EP 2312606 B1, where the actuator is integrated in the insulating housing of a pole part and where the bar and the screws can interfere with the housing when the size of the actuator is increased.

SUMMARY

An actuator is disclosed for a switchgear, comprising: a core including a package of core element layers made of magnetic material with permanent magnets between the core element layers; a movable plate made of magnetic material, the movable plate configured to open or close a magnetic circuit to the core; an electromagnetic coil, which is surrounded by the core elements; a central actuator rod; and at least one screw for mechanical connection of the core element layers and the permanent magnets, wherein the at least one screw is oriented perpendicular to a plane of stacking of the core element layers, and a screw-hole for each at least one screw is implemented through the core element layers and the permanent magnets, and wherein the screw-hole ends in a diameter extended opening, so that a screwhead of the screw is positioned and recessed into the diameter extended opening.

An actuator is disclosed for a switchgear, comprising: an electromagnetic coil; a core with a groove for accommodating the electromagnetic coil, the core including a plurality of core elements with permanent magnets between the core element layers; a movable plate configured to open or close a magnetic circuit to the core; and at least one screw for mechanical connection of the plurality of core elements and the permanent magnets, wherein the at least one screw is oriented perpendicular to a plane of stacking of the core element layers, and a screw-hole for each at least one screw is implemented through the core elements and the permanent magnets, and wherein the screw-hole ends in a diameter extended opening, such that a screwhead of the screw is recessed in the diameter extended opening.

BRIEF DESCRIPTION OF THE DRAWINGS

The subject matter of the disclosure will be explained in more detail in the following text with reference to exemplary embodiments, which are illustrated in the attached drawings, in which.

DETAILED DESCRIPTION

In accordance with an exemplary embodiment, an actuator is disclosed, which can avoid the mechanical infringement of the environment of the actuator by prominent screwheads.

In accordance with an exemplary embodiment, screws for a mechanical connection of the core element layers and the permanent magnets can be oriented perpendicular to the plane of stacking of the core element layers, and the screw-holes for the screws can be implemented through the core element layers and the permanent magnets, such that the screw-holes are located in diameter extended openings, so that the screwheads and/or the screwnuts can be recessed or sunken into the diameter extended openings.

In accordance with an exemplary embodiment, the permanent magnets can be dimensioned such that the permanent magnets and/or the magnetic core material of the layers can be dimensioned such that the amount of material reduction volume of the permanent magnets and/or the magnetic core element layers according to the extended openings and/or the screw holes, which can be aligned through the permanent magnets, is constructurally considered and the aforesaid material reduction volume is added at the flanks of the permanent magnets.

Figure 1:
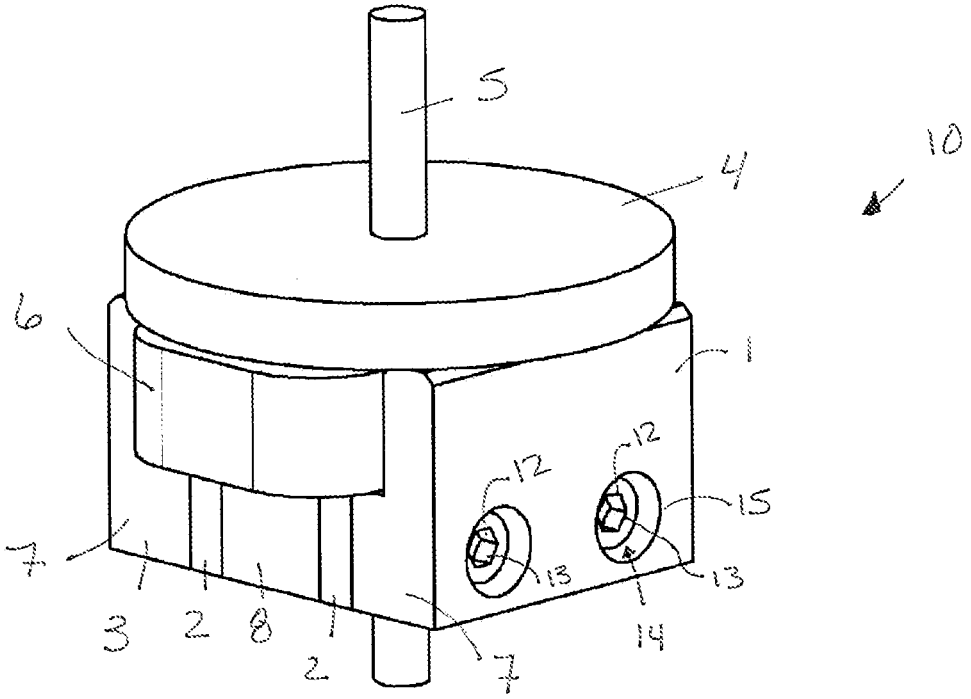
FIG. 1 show an exemplary magnetic actuator, wherein the screwheads are recessed or sunken such that the screwheads do not result in a mechanical conflict with the environment of the actuator.
Figure 2:
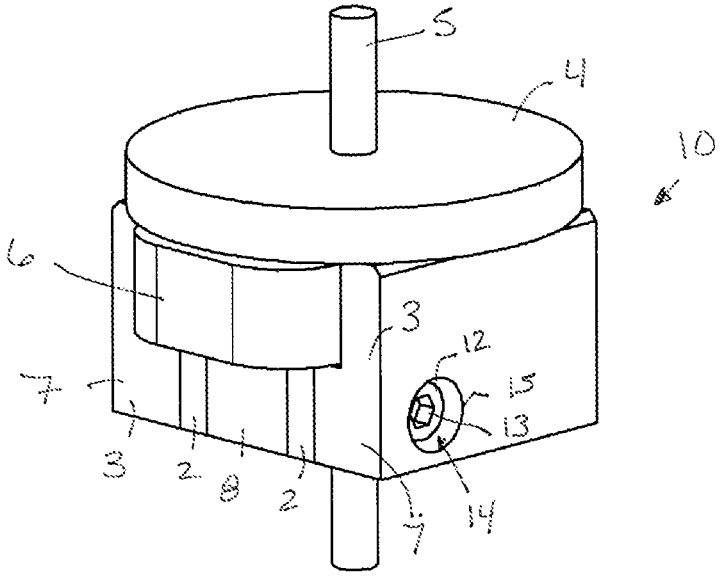
FIG. 2 show an exemplary magnetic actuator, wherein the screwheads are recessed or sunken such that the screwheads do not result in a mechanical conflict with the environment of the actuator.

FIGS. 1 and 2 show an exemplary embodiment of a magnetic actuator 10, wherein the screwheads 13 of the screws 12 can be recessed or sunken such that the screwheads 13 do not result in a mechanical conflict with the environment of the actuator.

In accordance with an exemplary embodiment, as shown in FIGS. 1 and 2, the actuator 10 for medium voltage (e.g., on the order of 50 kV or less) switchgear can include a core 1 which includes of a package or plurality of core elements layers (or core elements) 7 made of magnetic material, and permanent magnets 2 between the core elements 7, which can be fixed with screws 12 with screwheads 13. The core 1 can include one or more flanks 3 and a central core element 8. The actuator 10 can also include a movable plate 4 made of magnetic material. The movable plate 4 can be configured to open or close a magnetic circuit to the core 1. An electromagnetic coil 6 is surrounded by the core elements 7. The actuator 10 can also include a central actuator rod 5.

In accordance with an exemplary embodiment, the screws 12 for mechanical connection of the core element layers 7 and the permanent magnets 2 can be oriented perpendicular to the plane of stacking of the core element layers 7, and the screw-holes 14 for the screws 12 can be implemented through the core element layers 7 and the permanent magnets 2. The end of the screw-holes 14 can include diameter extended openings 15, which can be configured to receive the screwheads and/or the screwnuts 13, which can be recessed or sunken into the diameter extended openings 15.

Figure 3:
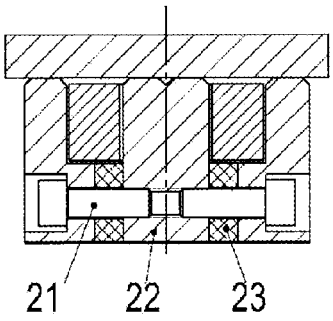
FIG. 3 shows a sectional view of an exemplary screw arrangement in accordance with an exemplary embodiment.

FIG. 3 shows a sectional view of an exemplary screw arrangement, which can include short screws 21 that go through the permanent magnets 23 and with their inner threads in the core 22.

Figure 4:
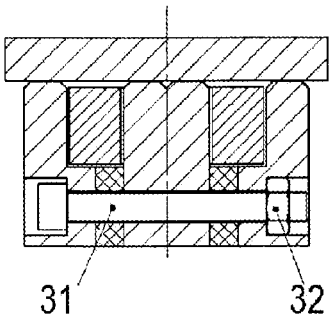
FIG. 4 shows a sectional view of an exemplary screw arrangement in accordance with an exemplary embodiment.

FIG. 4 shows a sectional view of an exemplary screwing arrangement, which can include a long screw 31 and a nut 32 arrangement, which extends through the permanent magnets 23 and core 22.

Figure 5:
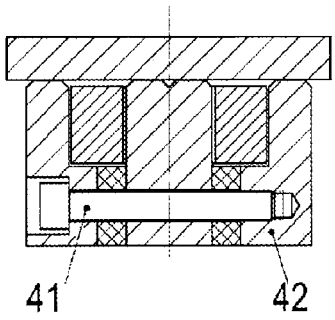
FIG. 5 shows a sectional view of an exemplary screw arrangement in accordance with an exemplary embodiment.

FIG. 5 shows a sectional view of an exemplary screw arrangement as shown in FIG. 2, which can include a long screw 41 having inner threads in the opposing flank 42.

In accordance with an exemplary embodiment, the volume of the diameter extended openings 15 of the screw holes 14 can be given by $Vo=\pi*Tm*D^2/4$ (Tm is the thickness of the magnet) and that the corresponding material volume extension of the flanks of the permanent magnets and or the core element layers is given by $Vm=dW*H*Tm$, so that $\Sigma Vo=\Sigma Vm$.

In accordance with an exemplary embodiment, the dimensioning of the needed magnetic or remnant bulk material of the core element layers can consider the extended openings in the screw holes. For example, in accordance with an exemplary embodiment, this can be considered directly in the construction of the core.

In accordance with an exemplary embodiment, one or more fixation screws can extend through holes in the permanent magnets and through holes and/or threads in the flanks and the core.

In accordance with an exemplary embodiment, the disclosed actuator can be used in medium voltage circuit breakers.

Figure 6:
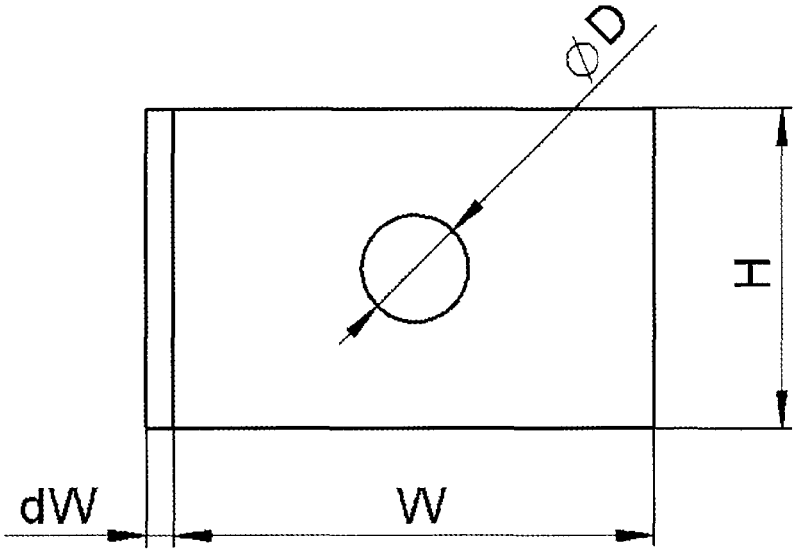
FIG. 6 shows an exemplary screw hole in accordance with an exemplary embodiment.

In accordance with an exemplary embodiment, the holes through the body of the actuator 10, for example, through the permanent magnets 23 can result in a reduction of the magnetic flux and therefore the locking force of the actuator. For example, a factor of the loss of flux can be the reduction of the effective area ($W\times H$) of the permanent magnet due to the hole with the diameter D. This reduced effective area can be compensated by an increase dW of the width W, as shown in FIG. 6.

In accordance with an exemplary embodiment, when the areas of the hole and the additional area at the side are identical, for example, $dW\times H=\pi\times D^2/4$, then the original effective area of the permanent magnet can be reconstituted and the locking force can be as for the actuator as shown in FIGS. 1 and 2.

In accordance with an exemplary embodiment, for example, the increase in width dW can be smaller than the diameter D of the hole, and can also be smaller than the additional width needed for the bar (not shown) and the screwheads 12, such that the overall dimensions of the actuator can be reduced without losing locking force.

In accordance with an exemplary embodiment, in the flanks 3, iron material of a relatively high diameter can be removed to give room for the screwheads. This region can be magnetically not very stressed, so that the removal of iron in this region will not result is a significant loss of locking force. In addition, because the bulky screwheads can be positioned where they do not infringe the environment of the actuator and do not reduce the locking force of the actuator.

In accordance with an exemplary embodiment, screw types can be chosen with a relatively low diameter of the head, for example, where space may be needed for the assembly tool, and the screw type can be, for example, screws according to DIN 912 or DIN 7984.

In accordance with an exemplary embodiment, locking elements for the screws can be a locking element that does not use a significantly higher diameter than the diameter of the screwheads themselves, for example, lock washers according to DIN 127 or DIN 128.

Figure 7:
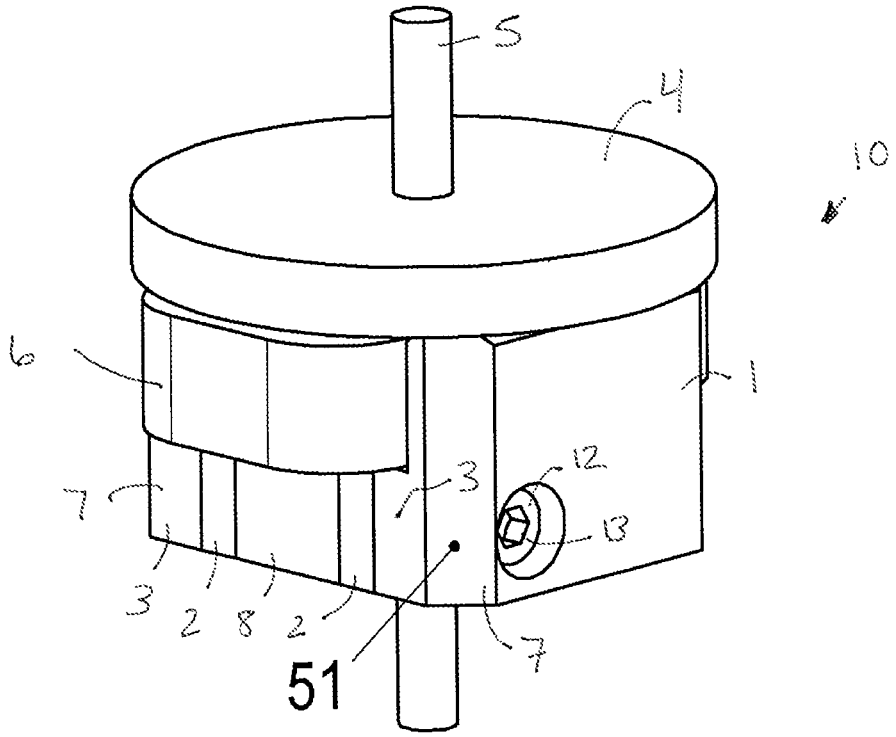
FIG. 7 shows an exemplary magnetic actuator in accordance with an exemplary embodiment.

In accordance with an exemplary embodiment, in case of further space constraints due to the application of the actuator, iron material can be removed from the corners 51 of the actuator 10 as shown in FIG. 7. In addition, since the iron of the flanks 3 may not be magnetically stressed, the locking force will not be significantly reduced by the removal of iron in this region. For example, with a design according to FIG. 2, this further reduction of the needed space for the actuator would not be possible.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An actuator for a switchgear, comprising:

a core including a package of core element layers made of magnetic material with permanent magnets between the core element layers; a movable plate made of magnetic material, the movable plate configured to open or close a magnetic circuit to the core;

an electromagnetic coil, which is surrounded by the core elements;

a central actuator rod;

at least one screw for mechanical connection of the core element layers and the permanent magnets, wherein the at least one screw is oriented perpendicular to a plane of stacking of the core element layers, and a screw-hole for each at least one screw is implemented through the core element layers and the permanent magnets, and wherein the screw-hole ends in a diameter extended opening, so that a screwhead of the screw is positioned and recessed into the diameter extended opening; and wherein the permanent magnets and/or the magnetic core material of the layers are dimensioned such that an amount of material reduction volume of the permanent magnets and/or the magnetic core element layers according to the extended openings and/or the screw holes, which are aligned through the permanent magnets, is added at flanks of the permanent magnets.

2. The actuator according to claim 1, wherein, a volume of the diameter extended openings of the screw holes is given by:

$$Vo=\pi*Tm*D^2/4,$$

and a corresponding material volume extension of flanks of the permanent magnets and/or the core element layers is given by:

$$Vm=dW*H*Tm,$$

so that $\Sigma Vo=\Sigma Vm$.

3. The actuator according to claim 1, wherein the at least one screw comprises:

a first screw which extends through the permanent magnets, and which has an inner thread in a central core of the core elements.

4. The actuator according to claim 3, comprising:

a second screw which extends through the permanent magnets and which has inner thread in the central core of the core elements.

5. The actuator according to claim 1, wherein the at least one screw comprises:

a screw and a nut arrangement, which extends through the permanent magnets and a central core of the core elements.

6. The actuator according to claim 1, wherein the at least one screw comprises:

a screw having inner threads in an opposing flank.

7. The actuator according to claim 1, wherein the at least one screw comprises:

two or more screws.

8. The actuator according to claim 1, wherein the at least one screw is a DIN 912 or DIN 7984 screw.

9. The actuator according to claim 1, comprising:

at least one locking element for the at least one screw.

10. The actuator according to claim 9, wherein the at least one locking element is a lock washer according to DIN 127 or DIN 128.

11. The actuator according to claim 1, wherein iron material is removed from at least one corner of the actuator.

12. A medium voltage circuit breaker, comprising:

an actuator according to claim 1.

13. An actuator for a switchgear, comprising: an electromagnetic coil; a core with a groove for accommodating the electromagnetic coil, the core including a plurality of core elements with permanent magnets between the core element layers; a movable plate configured to open or close a magnetic circuit to the core; at least one screw for mechanical connection of the plurality of core elements and the permanent magnets, wherein the at least one screw is oriented perpendicular to a plane of stacking of the core element layers, and a screw-hole for each at least one screw is implemented through the core elements and the permanent magnets, and wherein the screw-hole ends in a diameter extended opening, such that a screwhead of the screw is recessed in the diameter extended opening; and wherein the permanent magnets and/or the magnetic core material of the layers are dimensioned such that an amount of material reduction volume of the permanent magnets and/or the magnetic core element layers according to the extended openings and/or the screw holes, which are aligned through the permanent magnets, is added at flanks of the permanent magnets.

14. The actuator according to claim 13, comprising:

a central actuator rod.

15. The actuator according to claim 13, wherein the at least one screw comprises:

a first screw which extends through the permanent magnets, and which has an inner thread in a central core of the core elements.

16. The actuator according to claim 15, comprising:

a second screw which extends through the permanent magnets, and which has an inner thread in the central core of the core element.

17. The actuator according to claim 13, wherein the at least one screw comprises:

a screw and a nut arrangement, which extends through the permanent magnets and a central core of the core elements.

18. The actuator according to claim 13, wherein the at least one screw comprises:

a screw having inner threads in an opposing flank of the core elements.

* * * * *